US006338208B1

(12) United States Patent
Waterbury

(10) Patent No.: US 6,338,208 B1
(45) Date of Patent: Jan. 15, 2002

(54) SHORT SHOE SPIKE

(75) Inventor: Mark C. Waterbury, Bowling Green, OH (US)

(73) Assignee: Concurrent Technologies Corporation, Johnstown, PA (US)

( * ) Notice: Subject to any disclaimer, the term of this patent is extended or adjusted under 35 U.S.C. 154(b) by 0 days.

(21) Appl. No.: 09/408,662

(22) Filed: Sep. 29, 1999

Related U.S. Application Data

(63) Continuation-in-part of application No. 08/958,494, filed on Oct. 27, 1997, now abandoned.
(60) Provisional application No. 60/047,981, filed on May 28, 1997.

(51) Int. Cl.[7] ..... A43B 5/00; A43B 23/28; A43C 15/00

(52) U.S. Cl. ..... 36/134; 36/127; 36/62; 36/65; 36/67 A; 36/67 D

(58) Field of Search ..... 36/127, 134, 59 R, 36/62, 65, 66, 67 R, 67 A, 67 B, 67 D, 67 C, 59 B

(56) References Cited

U.S. PATENT DOCUMENTS

| | | | | | |
|---|---|---|---|---|---|
| 1,493,856 | A | * | 5/1924 | Golden | 36/62 |
| 1,559,086 | A | * | 10/1925 | Golden | 36/134 |
| 3,321,850 | A | * | 5/1967 | Coker et al. | 36/62 |
| 3,403,461 | A | * | 10/1968 | McCarney | 36/134 |
| 3,715,817 | A | * | 2/1973 | White et al. | 36/62 |
| 4,527,345 | A | * | 7/1985 | Lopez Lopez | 36/127 |
| 5,259,129 | A | * | 11/1993 | Deacon et al. | 36/127 |
| 5,293,701 | A | * | 3/1994 | Sullivan | 36/59 R |
| 5,367,793 | A | * | 11/1994 | Deacon et al. | 36/127 |
| 5,483,760 | A | * | 1/1996 | Kataoka et al. | 36/134 |
| D371,453 | S | | 7/1996 | Deacon et al. | |
| D371,895 | S | | 7/1996 | McMullin | |
| 5,533,282 | A | * | 7/1996 | Kataoka et al. | 36/134 |
| D373,675 | S | * | 9/1996 | McMullin | 36/134 |
| 5,581,913 | A | * | 12/1996 | Kataoka et al. | 36/134 |
| D378,013 | S | | 2/1997 | McMullin | |
| 5,623,774 | A | | 4/1997 | Abbey | |
| D380,076 | S | | 6/1997 | McMullin | |
| D385,988 | S | | 11/1997 | McMullin | |
| 5,689,904 | A | * | 11/1997 | Kataoka et al. | 36/134 |
| D387,548 | S | | 12/1997 | McMullin | |
| D389,299 | S | | 1/1998 | McMullin | |
| 5,727,340 | A | * | 3/1998 | Suk | 36/134 |
| 5,732,484 | A | | 3/1998 | Grutza et al. | |
| 5,752,332 | A | * | 5/1998 | Katkoka et al. | 36/134 |
| 5,860,228 | A | | 1/1999 | Bathum | |
| 5,887,371 | A | | 3/1999 | Curley, Jr. | |
| 5,906,059 | A | | 5/1999 | Singer et al. | |
| 6,006,454 | A | * | 12/1999 | Sitzler, Sr. | 36/127 |

FOREIGN PATENT DOCUMENTS

| | | | | |
|---|---|---|---|---|
| BE | 638580 | * | 10/1963 | 36/59 R |
| DE | 62336 | * | 12/1912 | 36/67 B |
| DE | 1956580 | * | 5/1971 | 36/67 D |
| DE | 3320286 | * | 12/1983 | 36/127 |
| GB | 2223394 | * | 4/1990 | 36/134 |
| IT | 467815 | * | 12/1951 | 36/67 A |
| GB | 664 | * | 1/1884 | 36/67 A |

OTHER PUBLICATIONS

Nikolai & Rieke, "8 mm Metal Spikes Get Failing Marks," Golf Course Management, Feb., 1998, pp. 49–55, vol. 66, No. 2, GCSAA Communications Inc., USA.

* cited by examiner

*Primary Examiner*—Paul T. Sewell
*Assistant Examiner*—Anthony Stashick

(57) ABSTRACT

A replaceable spike for sport shoes, molded from a durable plastic-type material, comprising a main body, concavo-convex disc having a top portion and a bottom portion. The top portion has a threaded post extending outwardly for removably attaching the spike to the sole of the shoe. The bottom portion, which is connected to the top portion, contains a plurality of nubs extending outwardly from the bottom portion for providing traction between the shoe and a supporting ground surface, while alleviating damage to the ground surface. Preferably, the nubs are at least three different sizes (small, medium, and large), based upon a fractal-like design, to provide surface roughness on multiple scales for increased traction.

18 Claims, 9 Drawing Sheets

1 - Dry Fairway 3 - Dry Rough
2 - Wet Fairway 4 - Wet Rough

1 - Dry Fairway 3 - Dry Rough
2 - Wet Fairway 4 - Wet Rough

.0875" O.C.
.0758" row spacings
0.11" Largest, #35 wire size
0.0465" Medium #56 wire size
0.020" Small #76 wire size Total, 73 pegs Large Medium Small

SHORT SHOE SPIKE

This application is a continuation-in-part of U.S. application Ser. No. 08/958,494, filed Oct. 27, 1997, now abandoned, which claims the benefits of U.S. Provisional Application No. 60/047,981, filed May 28, 1997.

BACKGROUND

The present invention generally relates to a traction device for attachment to the underside of a sport shoe. More particularly, this invention relates to a detachable, non-metal spike for a golf shoe, which includes a substantially non-penetrating, ground-engaging surface for providing increased traction and durability.

Spikes for golf shoes have long been used to provide traction in dirt and grass. These spikes have typically been made of metal. Traditional golf spikes have included a single metal spike, 6 to 8 mm in length. At this length, the spike penetrates the grass and passes into the roots and soil, providing a localized, essentially point, mechanical interlock, between the shoe and the sod. While this approach generates substantial traction, it also results in soil compaction and turf damage that degrades the quality of golf greens and increases their maintenance costs. In addition to turf damage, metal spikes also degrade golf carts, bridges, steps, tile floors, asphalt walkways, and clubhouse carpeting. Also, metal spikes that become loosened and fall from shoes during play damage mower blades.

Recently, golf courses have begun to prohibit the use of these traditional golf spikes due to the damage they cause to the turf, particularly to golf course greens. Starting in 1991, several courses in western states required golfers to wear spikeless athletic shoes during winter golf rounds. Within a few years, several prestigious courses followed suit and banned metal spikes. The revolution in non-metal spikes was underway with such momentum that metal spikes might be completely eliminated by 2001. Estimates by the National Golf Federation show that at the end of the 1998 golf season, one-third of the nation's 16,000 public and private courses had gone spikeless and many of the others strongly discouraged the use of metal spikes. In a resounding vote against metal spikes, currently 80 of Golf Digest's Top 100 courses are now spikeless.

One alternative to metal spikes features a shoe with a tread-like sole for traction, which is intended to replace the need for removable spikes. However, once the tread becomes worn, the shoe is no longer capable of providing adequate traction. The golfer must either purchase a new pair of shoes or find some way to resole the shoes with a comparable tread design.

As a compromise between metal spikes and spikeless shoes, an alternative polymer-based spike was developed that could be quickly inserted into the standard threaded holes of golf shoes. For example, one of the alternative designs replaced the single, long metal spike, or monospike, with a series of non-penetrating ridges for traction, which were formed in a fan-like design extending outwardly from the center of the spike.

The alternative spikes have several advantages. Even after dozens of rounds, the surfaces of golf course greens remain smooth, devoid of the metal spike marks that interfere with the accuracy of putts. While surface damage is virtually eliminated, subsurface root damage and soil compaction are also eliminated. In addition, less damage is inflicted on carpet, asphalt, and golf carts. Furthermore, the polymer-based spikes are lighter in weight and more comfortable than metal spikes, placing less strain on the user's feet, ankles, knees, hips, and back.

The use of non-metal spikes, however, has not been without problems. While green damage is reduced, the generally softer, polymer-based alternative spikes wear much more rapidly than metal spikes, requiring frequent replacement throughout the season. The alternative spikes can also loosen during use. In addition, the traction provided by many of the non-metal spikes currently on the market is inferior to metal spikes. For example, some current spike designs include a circular series of small protrusions approximately 2 mm in length around the perimeter of the base of the spike. This design provides little ground-engaging ability, particularly on wet surfaces. These spikes fail to develop sufficient torque and friction between the shoe and the turf, resulting in less traction.

Traditional metal spikes achieve traction through their single, long spike penetrating the ground, which prevents lateral shifting of the feet, particularly while swinging a golf club. The highly localized, near point loading provided by monospikes resembles a bolted mechanical joint in that the stresses are concentrated at the point of load application. These stress concentrations cause damage to the adjacent material, limiting the strength of the fastening and holding capabilities. For example, two wooden boards fastened together by a nail would be damaged as a shearing force attempts to tear the nail out of the wood. In the case of monospikes, the stresses are concentrated on, and cause damage to, the turf adjacent the spike.

Improved joint strengths can be achieved by spreading these stresses out over a larger area than a single point, providing more uniform loading. For example, the two boards described above could be fastened together by applying a glue or adhesive over an area between the boards, thereby forming an adhesive joint rather than a bolted mechanical joint. In the case of golf spikes, more uniform loading may be achieved by constraining the blades of grass over a larger region.

Alternative spikes invoke a different mechanism than do monospikes to secure traction. A non-penetrating spike cannot rely upon a puncture point loaded attachment, but instead, must rely on the adhesive or gripping qualities of the spike's surface for traction. Rather than penetrating the grass layer and digging into the soil beneath, low turf damage spikes grip the grass itself and transmit shear tractions through it, using the roots to attach to the earth beneath.

Current replaceable, non-penetrating spikes are not designed for optimal adherance to a grass surface. Adhesion is primarily created when spikes grip blades of grass. However, most non-penetrating golf spikes are not designed to grasp and hold onto grass blades. For example, one popular design uses a spiral geometry in an attempt to create adhesion. The design is apparently intended to allow for release when the golfer pivots during a drive. However, the design also allows for release during other foot movements, thereby reducing traction.

Thus, improvements in spikes for sports shoes, particularly golf shoes, are still being sought. What is needed is a replaceable spike that is less injurious to turf, especially golf course greens, and provides traction on dry and wet surfaces that is equal, or nearly equal, to that of the conventional 6 mm steel spike. Also, the spike should be lightweight and comfortable, and capable of enduring at least one season of play before replacement becomes necessary. Additional requirements include compatibility with standard threaded joints of existing golf shoes so that the low turf damage spikes can easily substitute for the traditional metal spikes, and means for attaching the new spikes that resists loosening of the spikes.

SUMMARY OF THE INVENTION

The present invention overcomes the shortcomings of known sport shoe spikes by providing a non-metal spike with enhanced durability and traction on wet and dry surfaces, without damaging turf such as golf course greens.

Using a concurrent engineering approach involving integrated design, material selection, and process development, a technically successful design and manufacturing process for the alternative, polymer-based spike of the present invention has been developed. A combination of experience-based prototypes, rapid prototyping (by solid freeform fabrication), and virtual prototypes were used to establish the design concept, design details, and process details. Success in implementing the concurrent engineering approach was aided by extensive discussions with golfers to gain a fundamental understanding of the problems with existing spikes, and to translate the problems into a coherent set of product requirements.

In one embodiment of the present invention, the spike is preferably formed as an integral, unitary body comprising a disc, cylindrical threaded post, and series of protrusions or nubs. The disc has a top and a bottom. The threaded post protrudes axially from the center of the top of the disc, which is threadedly received within an internally threaded socket on the sole of the sport shoe. The bottom of the disc engages a supporting surface such as turf, and has a plurality of spaced nubs extending outwardly from the bottom of the disc to provide traction between the shoe and the turf.

A large number of nubs, preferably more than about thirty, cover the bottom of the disc. The nubs, dispersed uniformly across the bottom of the disc, are present in a variety of heights and widths. The sizes, heights, and arrangement of the nubs are such that penetration of the soil is substantially eliminated. The large number of nubs increases the contact area, and thus friction, with the ground surface. The nubs provide traction with the turf by gripping blades of grass in the areas between the nubs and the shoe sole, providing a mechanical interlocking traction mechanism.

The design of the nubs is based on a fractal geometry design concept, with traction-generating nubs and other surface relief features repeating on successively smaller-size scales. The design concept is derived from research indicating that resistance to slipping (i.e., traction) between the fibers and matrix in composite materials is optimal when fiber surface roughness is introduced on many different size scales.

Beginning with an array of widely spaced large spikes, a succession of smaller-sized spikes arrayed between the large spikes continues to constrain grass blades when the spike engages turf. A filled polymer material composition supplies texture to the surface of the spike at the smallest scales, providing a friction coefficient contribution to the mechanical interlocking traction mechanism. The result of the fractal-based approach, combined with the large number of nubs, produces a system that approximates a continuous, adhesive-like attachment of the spike to the turf, rather than the localized, destructive loading mode of conventional metal spikes.

Besides traction and durability, another concern in the golf spike industry is ensuring the spikes are securely fastened to the shoe. Current designs use an oversized threaded polymer post to keep the spike from unscrewing. Oversized posts make insertion difficult due to increased friction. The present invention solves this problem by providing a locking mechanism with a tapered screw that is inserted into a central hole in the threaded post, thereby clamping the post to the inside of the threaded socket of the shoe sole.

Extensive tests and field trials indicate that the spikes of the present invention offer enhanced wear resistance, ease of attachment, greater initial non-penetrating traction on a variety of wet and dry grasses, and greater retained traction, even after significant wear.

From the foregoing, it will be apparent to the reader that a primary object of the present invention is to provide a spike for sport shoes that will create substantial frictional engagement between the shoe and a ground or supporting surface.

A more specific object of the invention is to provide a spike for golf shoes that provides traction between the spike and turf that is substantially similar to that of conventional metal spikes.

Another object of the present invention is to provide such a spike that is capable of uniformly distributing shear forces over a wider area of the spike disc bottom.

Another object of the present invention is to provide such a spike that is less injurious to turf.

Another object of the present invention is to provide such a spike that has an increased usable life.

Another object of the present invention is to provide such a spike that is lightweight and comfortable for the wearer.

A further object of the present invention is to provide such a spike that is replaceable and compatible with standard threaded sockets on golf shoe soles.

Still another object of the present invention is to provide an improved means of attaching the spike to the shoe sole to prevent loosening of the spike.

BRIEF DESCRIPTION OF THE DRAWINGS

These and other objects, features, and advantages of the present invention will become better understood upon review of the following description and accompanying drawings, in which.

DETAILED DESCRIPTION OF THE INVENTION

The invention summarized above and defined by the enumerated claims may be better understood by referring to the following detailed description, which should be read in conjunction with the accompanying drawings. This detailed description of a particular preferred embodiment, set out below to enable one to build and use one particular implementation of the invention, is not intended to limit the enumerated claims, but to serve as a particular example thereof. Those skilled in the art should appreciate that they may readily use the concepts and specific embodiment disclosed as a basis for modifying or designing other methods and systems for carrying out the same purposes of the present invention. Those skilled in the art should also realize that such equivalent assemblies do not depart from the spirit and scope of the invention in its broadest form.

General Description

Figure 1:
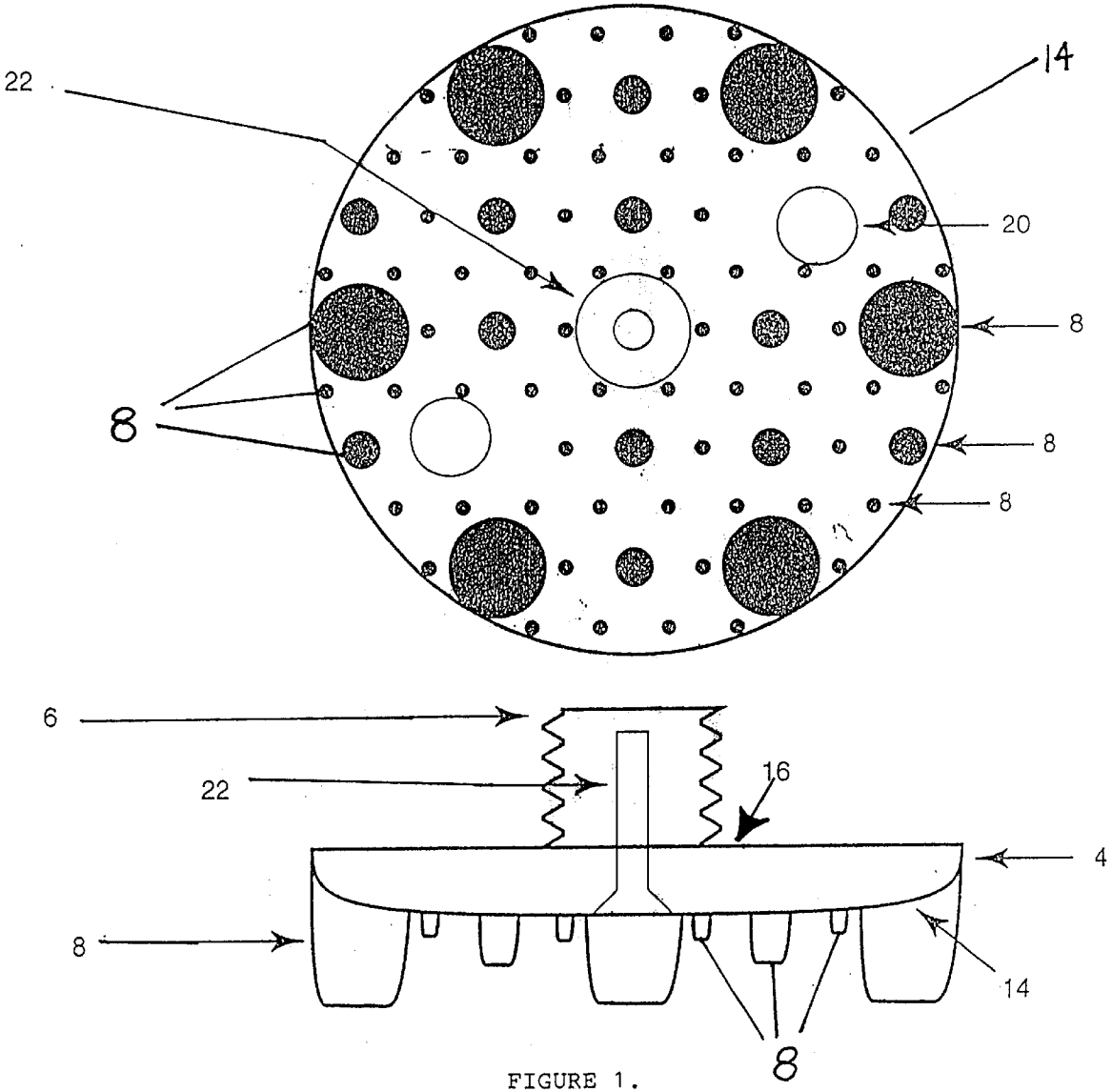
FIG. 1 illustrates a bottom view of the present invention in accordance with one embodiment of the present invention and a side view of the present invention in accordance with another embodiment of the present invention.
Figure 2:
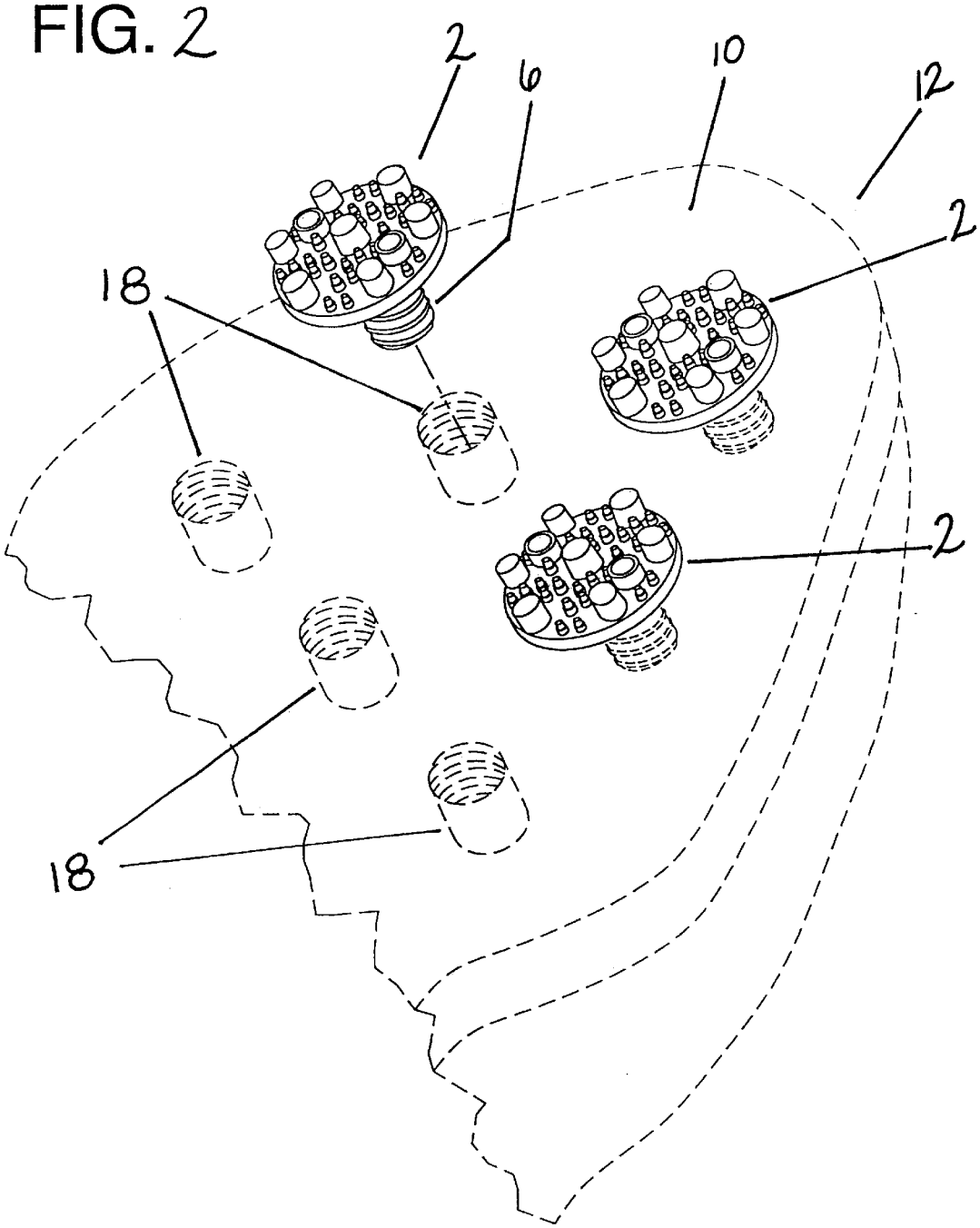
FIG. 2 is a perspective view of the present invention spike on the bottom of a shoe.
Figure 3:
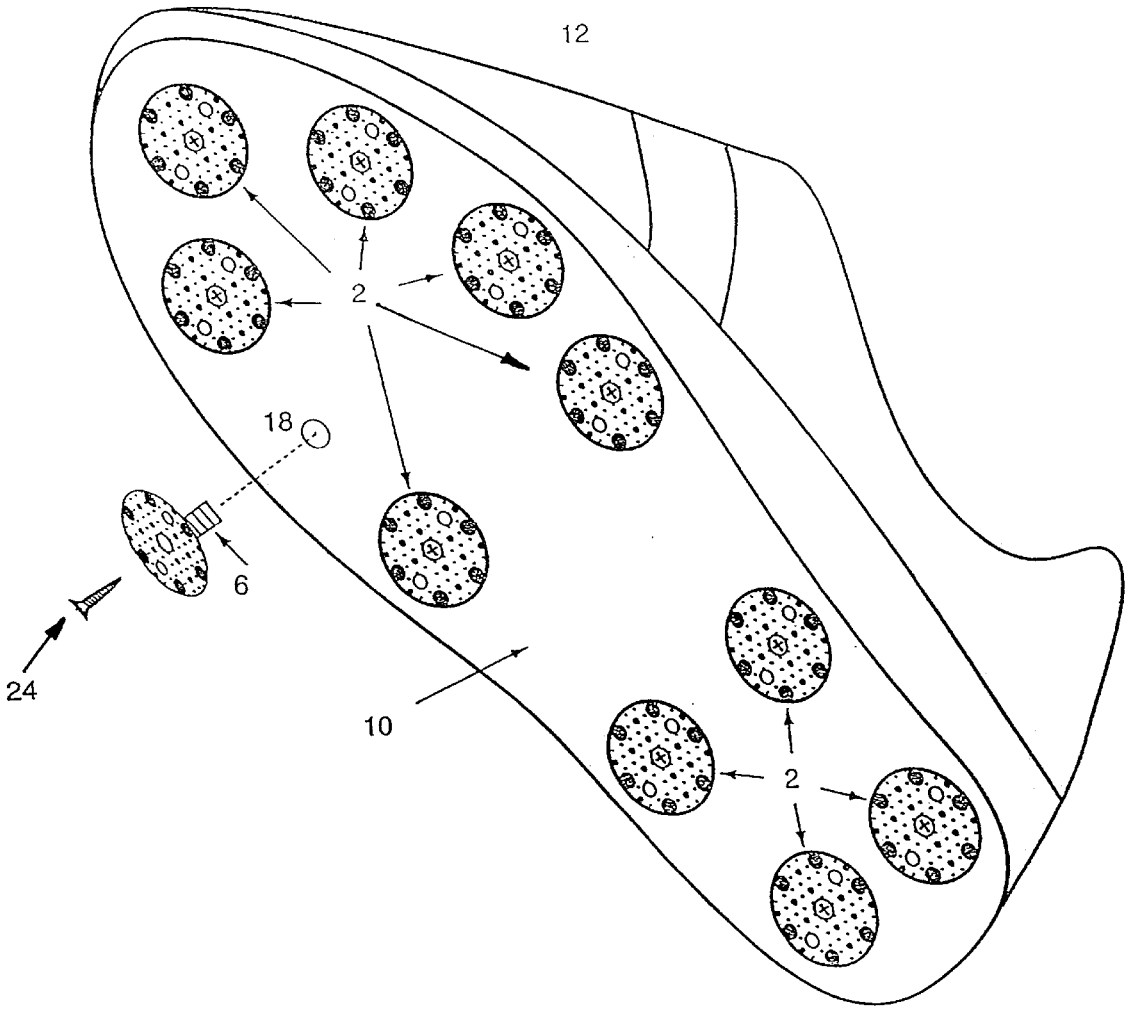
FIG. 3 is a perspective view of the present invention spike on the bottom of a shoe, illustrating the attachment of the spike to the shoe using a locking mechanism with a tapered screw, in accordance with one embodiment of the present invention.

A non-metal spike 2 according to the present invention is shown in FIGS. 1–3. The spike 2 comprises a main body in the shape of a disc 4, a top portion 16 of the disc 4 that selectively engages with a shoe 12 underside 10, and a bottom portion 14 of the disc 4, which is connected to the top portion 16, and which engages with a ground surface, providing enhanced traction between the shoe 12 and ground surface.

The spike 2 may be replaceably attached to the shoe 12 as illustrated in FIGS. 2–3. A threaded post 6 is formed on the top portion 16 of the spike 2 and protrudes perpendicularly therefrom. Although preferably non-metal, the post 6 may be metal and joined to the non-metal disc 4 by conventional means. Each spike 2 is attached to an internally threaded socket 18 on the shoe sole 10. The internally threaded socket 18 is adapted to receive the post 6 by rotating the post 6 relative to the socket 18. When secured to the shoe 12, the spike 2 extends substantially downwardly from the shoe sole 10 for engagement with the ground surface. When the spike 2 becomes worn, it can be removed from the shoe 12 and a replacement threadably reinserted into the socket 18.

Current low turf damage golf spikes tend to unscrew from the mounting threads within a socket, or are difficult to insert into the mounting threads. This difficulty is because current designs use an oversized threaded post to keep the post from unscrewing during use. The oversized post makes insertion difficult because the process is resisted by friction.

Figure 4:
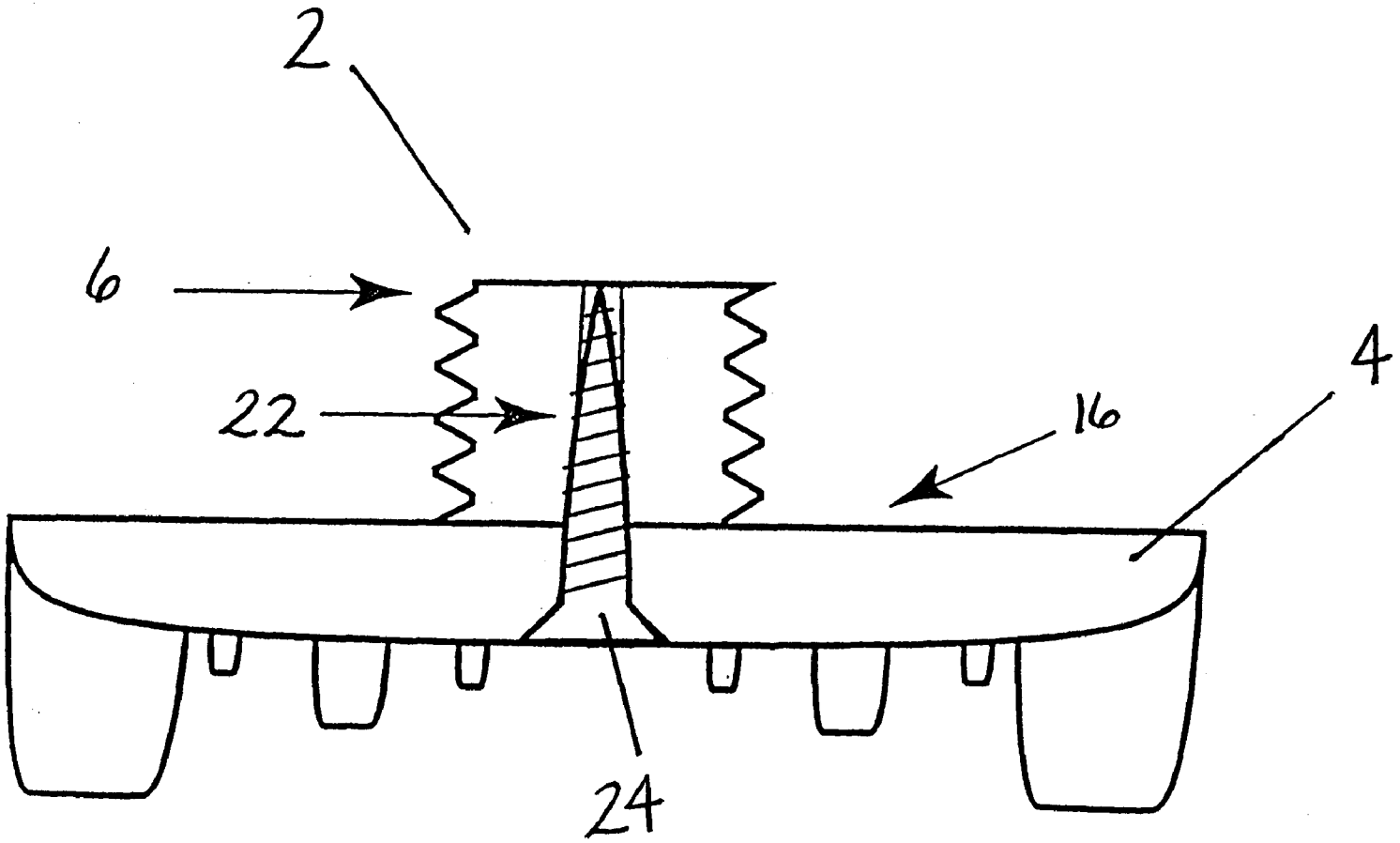
FIG. 4 is a side view of the present invention, illustrating the attachment locking mechanism in accordance with one embodiment of the present invention.

Alternatively, the present invention may use a locking mechanism for clamping the threaded attachment post 6 within the threaded socket 18 in the sole 10 of the shoe 12, as shown in FIGS. 3–4. This is accomplished by sizing the threaded post 6 to easily fit into the socket 18, but then locking the post 6 in place by the insertion of a tapered screw 24 into a central countersunk hole 22 in the threaded post 6. With this design, the spike 2 is easily inserted into the hole 22, in contrast to the difficulty resulting from posts that are deliberately oversized to allow them to be secured in place by friction. The post 6 is then forced outward against the threaded socket 18 by the tapered screw 24 and is thereby locked securely in place. Removal of the locked spike 2 is accomplished by reversing the process, first unscrewing the tapered screw 24 to release the clamping forces, then unscrewing the spike 2.

In another embodiment of the locking mechanism, both the socket 18 and the post 6 may be unthreaded, and attachment is accomplished entirely by the radial clamping forces. This alternative design allows rapid, simple replacement of the spikes 2 by simply sliding them into the shoe sockets 18 and locking them in place with the tapered screws 24.

The disc 4 preferably has a relatively flat bottom portion 14 and a relatively flat top portion 16 so that the top portion 16 rests securely on the sole 10 of the shoe 12. The disc 4 can also be rounded at the periphery. The disc 4 is preferably circular, but other geometric configurations such as elliptic, triangular, rectangular, square, and other polygonal shapes are acceptable.

The top portion 16 of the disc 4 can have a concave shape to create a spring effect when the spike 2 is tightened against the sole 10 of the shoe 12. As shown in FIG. 12, other configurations such as a dimpled or blistered surface 17 may also be added to the top portion 16 of the disc 4 to provide for a secure friction fit between the spike 2 and the sole 10 of the shoe 12. The disc 4 can also have a concavo-convex shape. However, the disc 4 is preferably relatively flat on both sides.

The bottom portion 14 of the disc 4 is the gripping surface, which provides enhanced traction between the shoe 12 and the ground surface such as the fairway or green surfaces of a golf course. The bottom portion 14 is designed to be substantially non-penetrating to the ground surface.

The bottom portion 14 contains a plurality of turf-engaging protrusions or nubs 8 extending perpendicularly from the bottom portion 14. The upper ends of the nubs 8 are connected to the bottom portion 14, and the lower ends engage the ground surface. The nubs 8 are preferably distributed evenly over the surface of the bottom portion 14 so that a substantially anti-slip engagement is formed between the shoe 12 and the ground. The nubs 8 are preferably tapered with the diameter of the upper ends being larger than the diameter of the lower ends. The lower, ground-engaging ends of the nubs 8 are preferably rounded, as illustrated in FIG. 1, to provide the best compromise between high traction and low damage to the turf.

In the preferred embodiment, three different sizes of nubs 8 are used—small, medium, and large. Preferred ranges for the number of nubs and nub measurements are provided in Table 1.

TABLE 1

| Item Measured | Preferred Ranges |
|---|---|
| On-Centers (distance between adjacent nubs) | 0.07– 0.09 in. |
| Distance between rows of nubs | 0.06– 0.08 in. |
| Diameter (at upper end) of large nubs | 0.10– 0.13 in. |
| Diameter (at upper end) of medium nubs | 0.04– 0.06 in. |
| Diameter (at upper end) of small nubs | 0.01– 0.03 in. |
| Diameter (at lower end) of large nubs | 0.09– 0.11 in. |
| Diameter (at lower end) of medium nubs | 0.03– 0.05 in. |
| Diameter (at lower end) of small nubs | 0.01– 0.03 in. |
| Length of large nubs | 0.15– 0.17 in. |
| Length of medium nubs | 0.06– 0.08 in. |

TABLE 1-continued

| Item Measured | Preferred Ranges |
|---|---|
| Length of small nubs | 0.02– 0.03 in. |
| Total number of large nubs | 6– 7 |
| Total number of medium nubs | 9– 20 |
| Total number of small nubs | 20– 70 |
| Total number of nubs | 35– 90 |

Use of smaller features is precluded by limitations of the injection-molding process. The small nubs are smaller in length and diameter than the medium nubs, and the medium nubs are smaller in length and diameter than the large nubs. Preferably, the small nubs are about half as long as the medium nubs, while the medium nubs are about one-half to about three-quarters the length of the large nubs. Also, preferably, the diameters of the large nubs are about twice that of the medium nubs, and the diameters of the medium nubs are about twice that of the small nubs.

The bottom portion 14 contains more small than medium nubs and more medium than large nubs. Preferably, the ratio of small nubs to medium nubs is about 3:1, and the ratio of medium nubs to large nubs is about 2:1. Furthermore, preferably, all large nubs are positioned along the perimeter of the bottom portion 14, while the medium and small nubs are distributed substantially evenly across the remainder of the bottom portion 14. When the alternative locking mechanism with tapered screw 24 is not used to attach the spike 2 to the shoe 12, a large nub may also be placed in the center of the bottom portion 14, as shown in FIG. 2.

Figure 10:
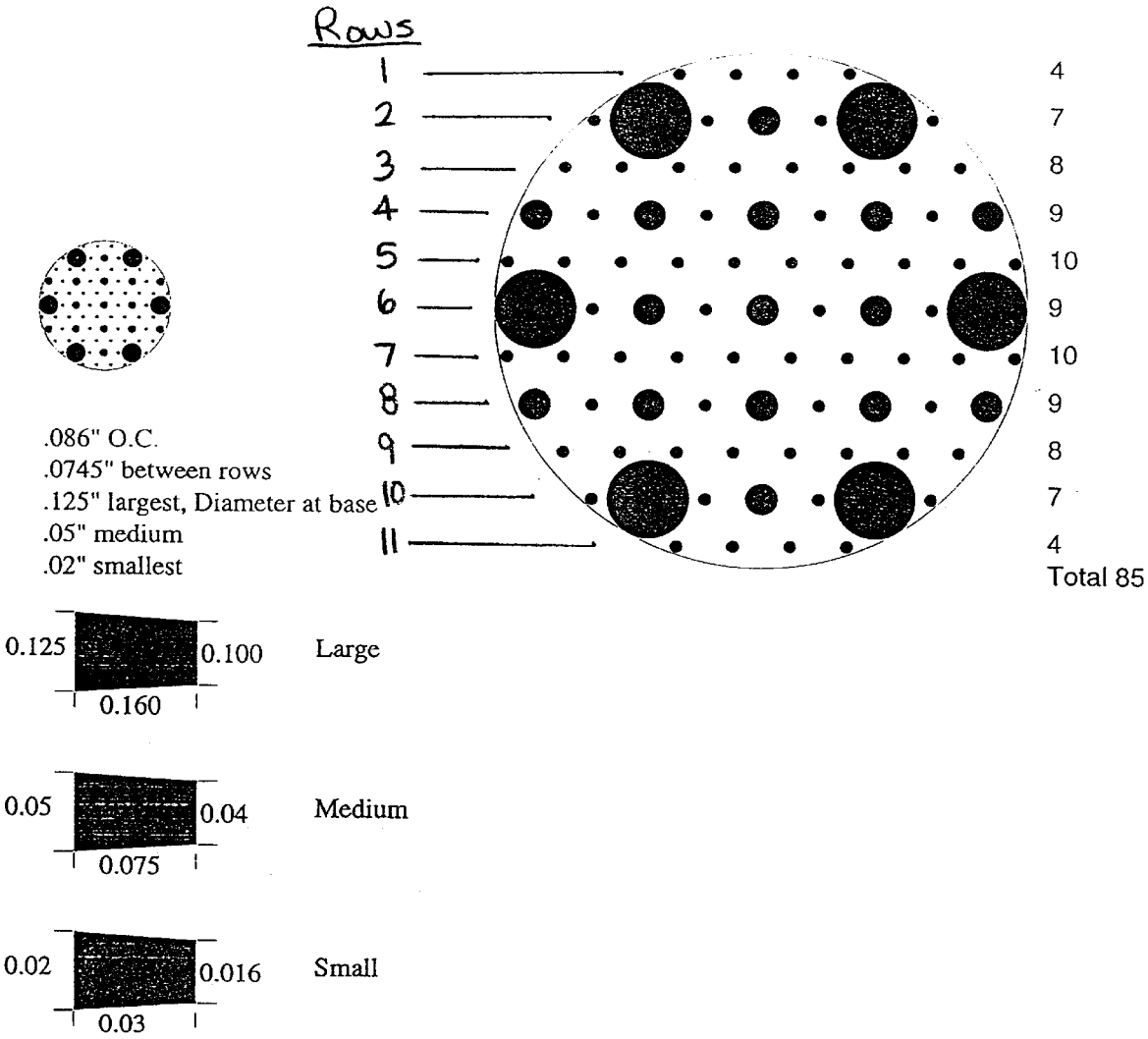
FIG. 10 is a bottom view of the present invention, in accordance with one embodiment of the present invention provided in Example 1.

Referring to FIG. 10, in a preferred embodiment, eleven rows of nubs 8 are distributed on the bottom portion 14 of the disc 4. The on-center (OC) distances (i.e., the distance between any two adjacent nubs) are the same, and the distance between the center points of any two adjacent rows (e.g., the distance between the fourth and fifth rows) is also the same. Also, every other row consists entirely of small nubs. In the remaining rows, the nubs are a mixture of alternating medium and small nubs, except for the rows (rows 2, 6, and 10) that contain large nubs. In these three rows, the first and last medium nubs are replaced with large nubs. Thus, for the embodiment shown in FIG. 10, every medium nub is completely surrounded in a circular or hexagonal fashion by six small nubs, except for the medium nubs closest to the perimeter of the bottom portion 14. Similarly, the large nubs and medium nubs closest to the perimeter are partially surrounded in a circular fashion by small nubs.

As the nub sizes decrease, the distance between like-sized nubs also decreases. In a preferred embodiment, such as the one shown in FIG. 10, the distance between adjacent medium nubs (such as those in row 8) is approximately one-half the distance between adjacent large nubs (such as those in row 10). Likewise, the distance between adjacent small nubs (such as those in row 3) is approximately one-half the distance between adjacent medium nubs (such as those in row 4).

Thus, from the foregoing, the reader can see that the present invention advantageously uses, in essence, the entire surface of the bottom portion 14 of the spike 2. The numerous nubs increase the contact area and hence friction between the spike 2 and the turf. Moreover, the multiple nub sizes increase the surface roughness of the bottom portion 14 of the spike 2, which provides greater friction when the spike 2 begins to slide laterally on the turf. Therefore, the combination of numerous nubs 8, multiple sizes of nubs 8, and positioning of the nubs 8 on the bottom portion 14 of the spike 2 serve to provide a shoe spike with enhanced traction.

When the shoe is set down on the turf, an area of turf is compacted underneath the spike 2. The nubs 8 are designed and arranged to frictionally engage blades of grass, thereby gripping the turf and resisting slipping of the shoe 12. The numerous and various-sized nubs 8 grip the blades of grass and evenly distribute stresses. The uniform distribution of stresses achieved by the spike/grass interface resembles that of an adhered joint described above. An example of an adhered joint is two pieces of wood held together by glue. Stresses associated with holding the two pieces of wood together are evenly distributed over the point of contact or joint by the adhesive qualities of the glue. A glued joint holds firm against shearing forces because of the many points of adhesion, which evenly distribute the forces. An adhered joint provides a stronger attachment than a weaker point loaded attachment. However, unlike adhesive joints that provide resistance to both shearing (horizontal) forces and normal (vertical) forces, the objective of the spike 2 is to provide shear resistance and, at the same time, little or no resistance to normal forces. In other words, the spike 2 provides resistance to a user's foot slipping laterally on the turf, but little or no resistance to the user's foot pulling up from the turf. Thus, the numerous and various-sized nubs 8 are able to provide a firmer footing for the golfer.

Traction is determined by the shear strength of the grass/sod/spike interface. Grass is interlocked by the various-sized nubs 8 of the spike 2 to provide traction. Having nubs 8 of various sizes distributed throughout the surface of the bottom portion 14 of the spike 2 provides a surface roughness capable of interlocking with the grass. Surface roughness can also be accomplished on a much smaller scale by texturing the surface of the nubs 8 and the bottom portion 14 of the disc 4 with a particulate filled polymer. The resulting microscopic roughness of the spike 2 would increase its adhesive properties by providing many unique microscopic points of contact.

The nubs 8 are sized and positioned on the bottom portion 14 of the disc 4 according to a fractal-like design. A fractal is a shape that can be subdivided in part, each of which is, at least approximately, a reduced-size copy of the whole. Fractals are generally self-similar and independent of scale. The present invention is fractal-like in that the traction producing elements (i.e., the nubs 8) are replicated on several different size scales. Mechanical interlocking and gripping is obtained at each of the differing size scales, forming numerous points of adhesion, to obtain a high level of traction.

The spike 2 is typically formed from any suitable durable, resilient, non-metal material with good wear-resistant properties. The spike materials are selected for their durability, abrasion resistance, traction-developing characteristics, strength properties, and manufacturability. An elastomer is the preferred material. Desirable performance and manufacturing properties are achieved by use of synthetic plastic resins, for example, polyether block urethane, available as Estane™ from B.F. Goodrich Company, and Ultem™ polymer resin from General Electric. In the preferred embodiment, the spikes 2 are made of a polyurethane polyester known as Textron 290 available from Bayer.

Preferably, the spike 2 is molded from a durable plastic material in a single, unitary fashion. However, in an alternative embodiment, the spike 2 may incorporate different materials having different characteristics for the disc 4, nubs 8, and post 6. For example, the threaded post 6 may be manufactured from a metal material while the remainder of the spike 2 may be made of a synthetic plastic material. In this case, a metal flange may be used to attach the metal post 6 to the disc 4, as can be seen, for example, in the XP-M spike by Softspikes, Inc. of Rockville, Md. The disc 4 can also be formed around the post 6 so that the post 6 is embedded within the disc 4. Another embodiment has the threaded post 6 extending above the top portion 16 and down through the surface of the bottom portion 14 of the disc 4. The end of the threaded post 6 extends through the surface of the bottom portion 14 and has a metal hollow hex-head for engaging the spike 2 so that the spike 2 may be screwed into the threaded socket 18. In lieu of the metal hex head, other geometrically patterned fastener head designs, such as a Phillips or flat head, may be used.

In addition, a pair of installation tool engagement holes or drive holes 20 may optionally be formed at diametrically opposing points in the bottom portion 14, whereby the spikes 2 may be tightened to, and removed from, the shoe 12 using a conventional installation tool. Engagement holes 20 provide another alternative to the hex-head design. The two prongs of a conventional golf spike installation tool fit into the two engagement holes 20. Once engaged, the tool can drive the spike 2 into the threaded socket 18. Engagement holes 20 may be used in addition to the hex-head design or other means for engaging the spike 2.

Design Approach/Considerations

Development of the spike 2 was carried out using a concurrent engineering approach to ensure that the product design meets performance requirements, yet is manufacturable at reasonable cost. This required collaboration between designers and production engineers using experience-based knowledge as well as new knowledge generated by testing, modeling, and prototyping.

Surveying other engineering systems where shear tractions may come into play provided a design concept for the spikes 2 from experience-based prototypes. Design details were then determined by rapid prototyping (to establish the best geometric design for traction), material testing (to measure wear behavior as well as moldability characteristics), and process modeling (to ensure that the material and geometry combination was moldable). This approach ensured a spike design and processing system that met performance requirements with reasonable manufacturing costs.

Existing alternative golf spikes were first examined to gain some insight into the merits of various geometric design features. The alternative spikes examined can be classified into the following groups: (1) spikes having a circular pattern of small, round spikelets or nubs; and (2) spikes having a spiral, radial, or circular pattern of robust ridges. The first group appeared to provide adequate traction but at the expense of rapid wear rate, while the second group had relatively low wear rate but limited traction. The spiral geometry of the second group appears to be intended to allow release when a golfer pivots during drives. However, most of the "vanes" or ridges also allow release during other foot movements, hence poor traction. It is believed that the greater area of the ridges and the greater support for the material from the ridges compared to nubs probably contributes to the reduced wear.

The interaction between the spikes and sod further explains the differences between the two groups. Sod consists of, among other things, blades of grass, soil, and roots. The grass blades have a certain amount of stiffness. A finite load (i.e., the golfer) bears down on the spikes and presses them down into the sod. The blades of grass bend and conform to the spikes, but the conformation is limited. Imagine a set of continuous ridges (in a spiral, circular, or radial pattern) pressed against blades of grass that are lying on their sides under the load. The grass must bend up, across, and back down to accommodate the ridges. The ridges then stay on top of the grass blades rather than penetrating into the roots and soil. Now imagine a set of nubs. The nubs can penetrate down between the grass blades, sinking deeper into the turf, trapping the turf between the nubs, thereby gripping a large region of sod. The resulting traction is much greater.

During the golf swing, the twisting and sliding action of a golfer's foot on the turf develops shear at the interface between the turf and shoe surface. Geometric features on the shoe surface must provide sufficient friction to withstand those shear tractions without slipping. Friction between any two surfaces occurs because of the interaction between the minute protrusions, or asperities, on both surfaces. Rougher surfaces have higher asperities, which increases friction and, consequently, the shear force necessary to move one surface relative to the other parallel to the interface. Because the asperities on one surface generally have a wide range of sizes, friction is enhanced if the other surface also has a similar range of sizes of asperities. For example, a rough surface on a hard, smooth surface provides very little friction.

To meet both major design criteria of reduced wear and increased traction, other engineering systems that undergo behavior similar to the shear that develops between a golf shoe and turf were reviewed. One engineering system in which shear tractions play a strong role is composite materials. The strength of composite materials relies on high shear strength at the interface between the matrix and the reinforcing fibers of the composite. Research in composite materials has shown that this interface strength is enhanced if the fiber has a range of asperity sizes because the matrix material microstructure has geometric features of various sizes.

Extrapolating these findings to the problem of traction between golf shoe spikes and turf, we must first recognize that turf is made up of grass of varying thicknesses and widths (0.0100 to 0.3000 inches), as well as a root structure (0.0050 to 0.0200 inches) within dirt containing particles of various sizes (0.0001 to 0.2000 inches). To best interact with this variety of feature sizes in the turf, the golf spike should, likewise, have features with a variety of sizes. That is, the spike should be made up of nubs having a variety of sizes, much like fractal geometry has features that are discernable at several levels of resolution.

The resulting traction is essentially the same as the mechanical interlocking contribution to interfacial shear strength. The shear strength of the grass/sod/spike interface that is interlocked by the nubs is probably the limiting factor in determining traction. The nubs need to grab hold of enough sod so that they do not break free and cause poor traction and turf damage. Smaller diameter nubs can grab larger areal fractions of sod, hence greater traction. Nubs that cover half of the overall spike would both dig in less deeply under a given load and hold a smaller surface area of the weak sod. The slope of the lateral flanks of the nubs also affects traction. Making the nubs nearly vertical would be preferable. However, some compromise to make them manufacturable is necessary.

Geometric Design

The purpose of using different-sized nubs 8 is to introduce surface roughness. Surface roughness may also be introduced on a much smaller scale by using a particulate filled polymer, and possibly by using a microcellular foam, to carry the fractal gripping concept down to micron sizes.

The number of different nub sizes of the preferred embodiment was set by the traction requirements and manufacturing limitations. The largest nubs were chosen to give the maximum penetration without causing damage to the sod. The smallest readily available die machining tools set the smallest nubs. Also, if the nubs 8 were any smaller, the injection-molding process would not be able to form them. The intermediate size was used because the recurrent, fractal requirement of the design dictates multiple spike sizes to entrap the sod features (grass blades, roots, and soil particles) on multiple size scales. Four or more different sizes of nubs 8 may be used if manufacturing limitations can be overcome. Two sizes do not provide the range of fractal sizes needed for effective traction.

The specific geometric design or layout for the bottom portion 14 of the spikes 2 was determined in the following manner. In two dimensions, the closest possible packing of circular objects (i.e., nub cross-sections, as illustrated in FIG. 1) is a hexagonal, close-packed lattice. This geometry gives the greatest number of circular nubs 8 in the smallest space, with the maximum distance between the nubs 8. A square pattern of nubs, for example, would place fewer nubs in the same area, or the same number of nubs but with closer spacing. The greater the number of nubs in a given area, the higher the traction, until a limit is reached as the nubs merge together and no longer efficiently trap grass and sod between them. This is also the reason for requiring the greatest possible spacing between the nubs. Combining these two requirements leads to a hexagonal lattice. For the spike 2, the space available is not infinite, as in the packing of an infinite plane, but is limited to the space within a standard golf spike mounting disc. For that reason, the outermost ring of nubs 8 is placed exactly at the outer diameter of the bottom portion 14 of the disc 4. This constraint then determines the spacing between the nubs 8 (lattice parameter) within the hexagonal close-packed lattice.

Other golf spikes do not utilize a hexagonal arrangement of nubs in combination with a close-packed lattice. Unlike the spike 2 of the present invention, other spikes do not attempt to optimize the distance between nubs and the number and sizes of nubs to improve traction.

Wear aspects influenced selection of nub 8 diameters. Wear of a golf spike occurs due to the slight sliding and twisting actions during walking, particularly on asphalt or concrete golf cart paths or runways between pro shops, parking lots, and clubhouses. Wear, another friction phenomenon, increases with the distance of sliding, the normal pressure between the sliding surfaces, and the wear resistance of the material surfaces. Therefore, wear of the nubs 8 can be reduced by increasing their diameter, which reduces the contact pressure on the nubs 8. Likewise, using a material with greater wear resistance (generally, a higher hardness) will also decrease the wear rate of the spikes 2.

Manufacturing processes influenced selection of the spike material. Product design involves specification of the geometric features of the part and selection of the material(s). In the case of the spike 2, these factors affect both performance objectives—reduced wear and increased traction. However, the geometric features and the material chosen must also be compatible with the manufacturing processes to be used for production of the parts. That is, in the case of injection molding of the spike, the geometric features must be moldable, the material must have sufficient fluidity to fill the mold cavities, and the mold features (negative image of the part features) should be easily machinable by standard machine tools and procedures.

Various polymers were evaluated for wear resistance by pulling them across a concrete block under vertical load. Flow models were also used to ensure that the combination of polymer material and mold shape permitted complete filling during the injection-molding process as well as ease of release from the injection-molding die. These tests provided information on the smallest size nub that could be formed. Molding parameters were also determined, including the material temperature, die temperature, and dwell time, for best molding performance.

The spikes are formed on a Cincinnati Milacron injection-molding machine, in a four-spike tree mold configuration, at the rate of two shots per minute. The spikes are then trimmed from the shot tree and ready for use without further treatment. The injection-molding die consists of separate inserts for the top portion 16 and bottom portion 14 of the spike 2. This permits easy interchange of inserts for producing both the large standard and small standard threaded posts 6. In addition, the use of inserts enables quick modification of the nub sizes and arrangement. A special geometric feature is molded into the post 6 to ensure a tight fit and resistance to loosening of the spike 2 during use.

Spike Tests

Figure 5:
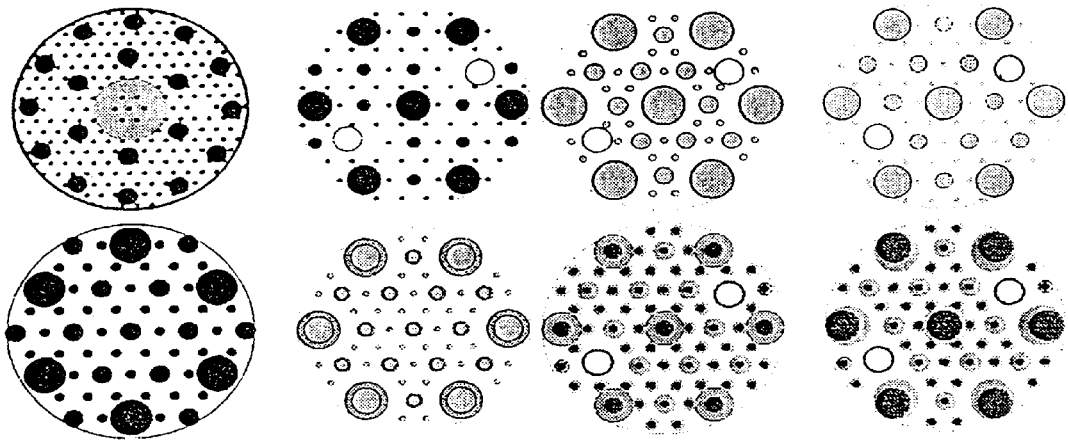
FIG. 5 displays examples of alternative spike designs evaluated during testing of rapid prototypes, including the spike of the present invention.
Figure 6:
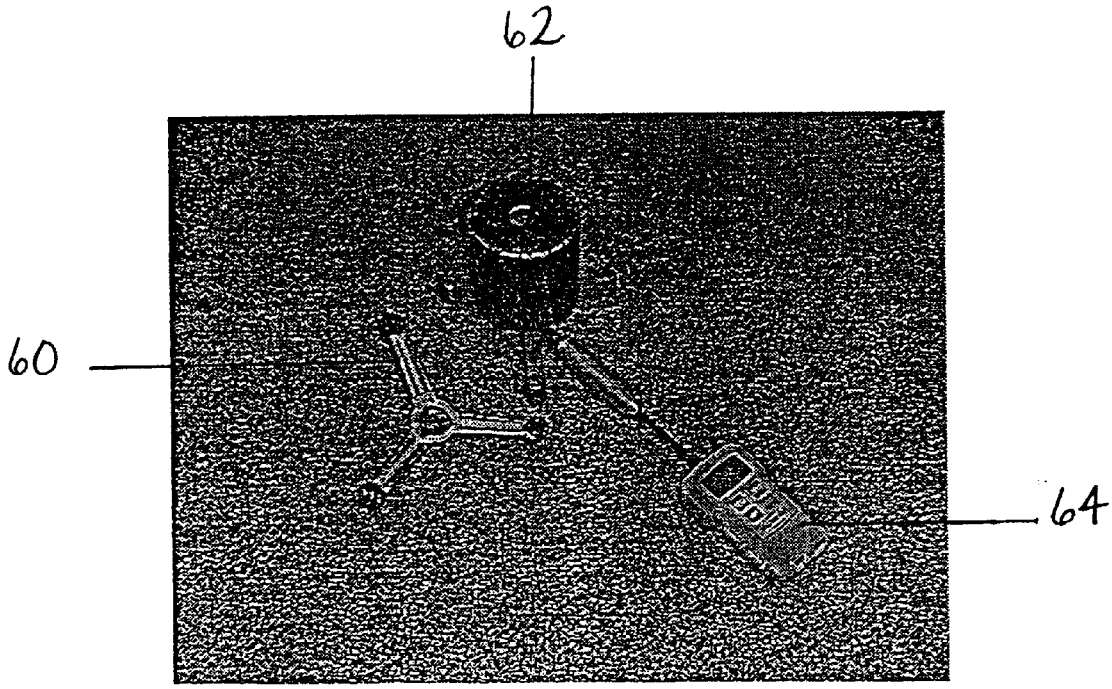
FIG. 6 displays the test rig used for evaluating traction limitations of various golf spikes, including the spike of the present invention.

FIG. 5 shows a sampling of potential spike designs using the fractal concept with three different nub sizes. Using a computer-aided design (CAD) system, solid models of each of these alternatives were generated. The computer files for each model geometry were sent by Internet links to a rapid prototype service center, which provided full-size plastic models of each design. These designs were then tested by mounting them in a tripod base, placing a vertical load equivalent to the weight of an average golfer, and applying a horizontal force to measure the traction at slippage. FIG. 6 shows the test rig consisting of the tripod base 60 containing the spikes, weight 62, and electronic force gauge 64. Tests were conducted on fairway, intermediate, and rough turf, as well as tee boxes, sand traps, and pine straw at Sunnehanna Country Club in Johnstown, Pa.

The spikes of the present invention (also referred to as "SunSpikes™") and competitor spikes were tested for abrasive wear resistance and for traction using standardized test procedures. For comparison, additional traction tests were conducted on spikes that had undergone significant wear. Also, several golfers in different parts of the country conducted field trials on various turf conditions. Volunteers wore the spikes, recording the number of rounds played and typical walking distance on cart paths and walkways. They also reported their impressions of feel, comfort, and traction. The spikes were removed periodically for measurement of wear and damage, which was correlated with user input.

Figure 7:
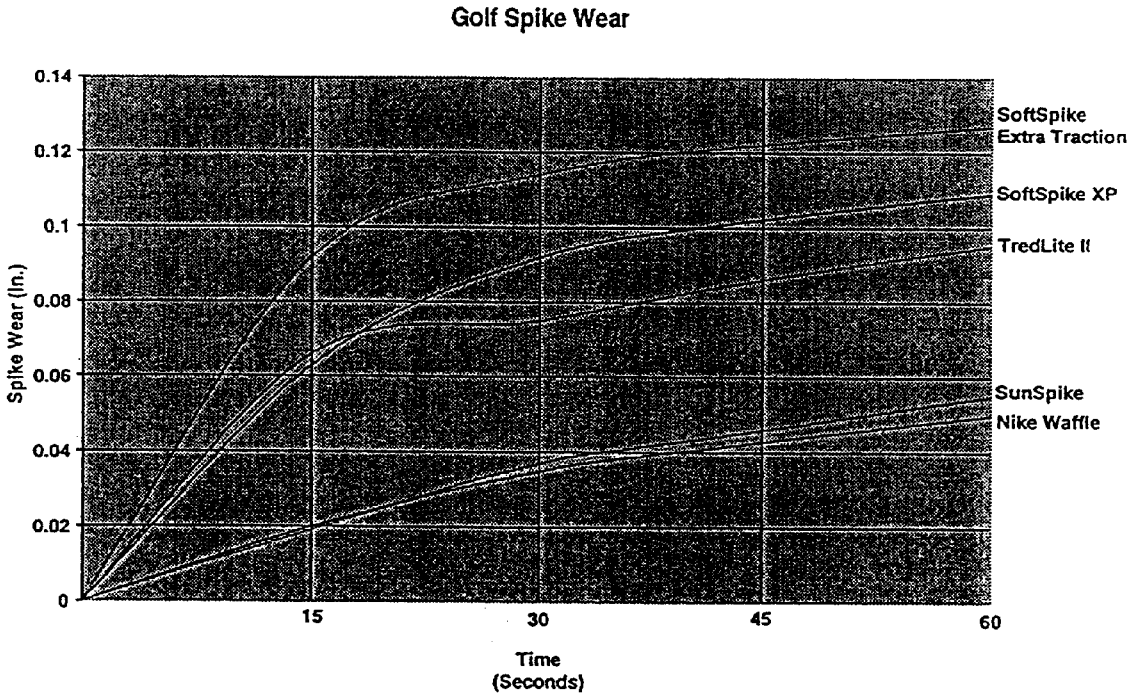
FIG. 7 graphically displays wear of various golf spikes, including the spike of the present invention.

Abrasive wear tests were conducted on the spikes by applying a fixed normal load to the spikes against a rapidly rotating abrasive surface simulating concrete. The samples were periodically removed to measure the degree of wear in terms of change in length of the spikes. The results are shown in FIG. 7. The high rate of wear of the Softspikes XP and XT are due to the low hardness of the spike materials and the small diameter of the nubs. TredLite II shows less wear because the nubs are larger in cross-section. Nike Waffle spikes show much reduced wear, similar to that of the spike of the present invention, because the nubs are large in cross-section and the material has a high hardness.

Figure 8:
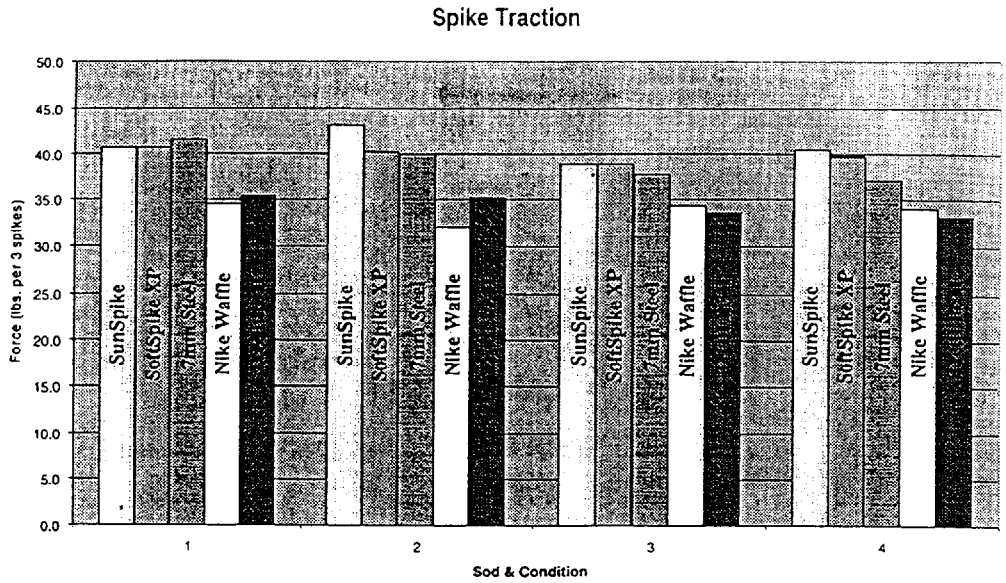
FIG. 8 graphically illustrates traction of various golf spikes, including the spike of he present invention.
Figure 9:
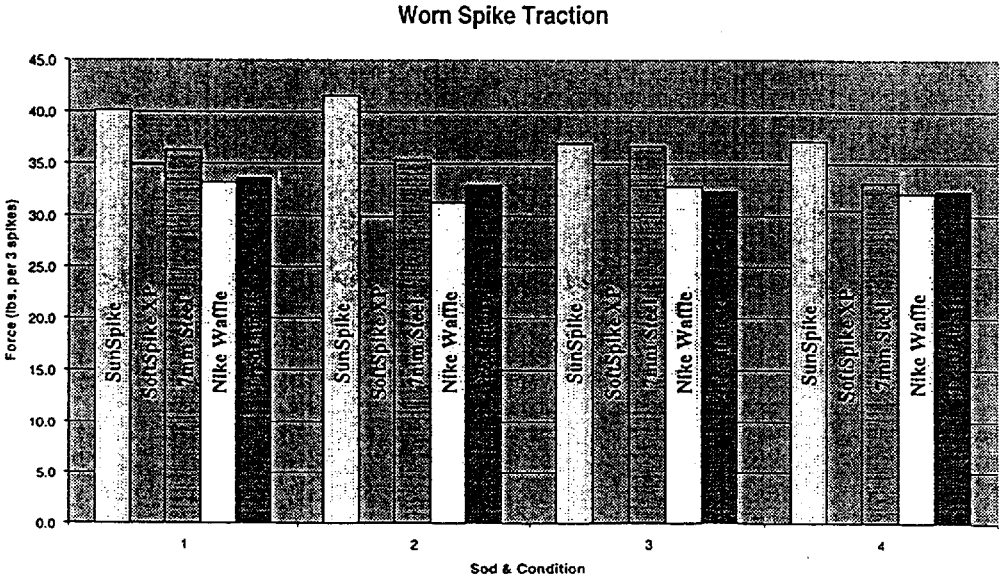
FIG. 9 graphically illustrates traction of various golf spikes after wear, including he spike of the present invention.

Traction tests were also conducted on the same spikes using the test rig described previously and shown in FIG. 6. Three spikes on the tripod base were loaded simultaneously by a weight such that each spike was under the same force it would experience on the foot of the average golfer. The tripod base was then pulled horizontally and the force at which the spikes broke free from the turf was measured, simulating slippage or loss of traction. Tests were conducted on dry and wet fairways as well as dry and wet two-inch rough. The results, shown in FIG. 8, illustrate that the traction of the spike of the present invention is equivalent to or greater than that of other spikes, except for the metal spike under dry fairway conditions. In addition, each type of spike was worn an equal amount using the abrasion wear test machine, and retested for traction. The results shown in FIG. 9 illustrate that the spike is far superior to other spikes in the worn condition.

Field trials by golfers using the spikes of the present invention over a period of several months confirmed the superior traction, extended wear, and greater comfort of the spikes. The fractal design of the spikes is proven to be effective in the new condition, but the effectiveness is maintained in the worn condition. As the large, primary nubs of the spike are worn, the smaller nubs remain intact to provide traction, albeit at a slightly reduced level. Therefore, the traction performance of the spikes of the present invention decreases less severely than other spikes tested in the worn condition.

The following examples and tables are provided merely to illustrate the present invention, and it is to be understood the invention is not limited thereto.

EXAMPLE 1

In one embodiment of the present invention, as illustrated in FIG. 10 (without drive holes 20 displayed), satisfactory results were achieved with the dimensions and number of nubs 8 provided in Table 2.

TABLE 2

| | |
|---|---|
| On-Centers (distance between adjacent nubs) | 0.0860 in. |
| Distance between rows of nubs | 0.0745 in. |
| Diameter (at upper end) of large nubs | 0.1250 in. |
| Diameter (at upper end) of medium nubs | 0.0500 in. |
| Diameter (at upper end) of small nubs | 0.0200 in. |
| Diameter (at lower end) of large nubs | 0.1000 in. |
| Diameter (at lower end) of medium nubs | 0.0400 in. |
| Diameter (at lower end) of small nubs | 0.0160 in. |
| Length of large nubs | 0.1600 in. |
| Length of medium nubs | 0.0750 in. |
| Length of small nubs | 0.0300 in. |
| Total number of large nubs | 6 |
| Total number of medium nubs | 15 |
| Total number of small nubs | 64 |
| Total number of nubs | 85 |

EXAMPLE 2

Figure 11:
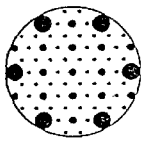
FIG. 11 is another bottom view of the present invention, in accordance with another embodiment of the present invention provided in Example 2.
Figure 11:
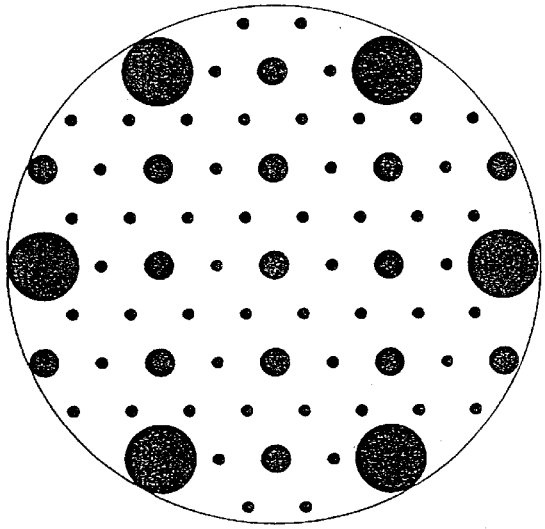
Figure 11:
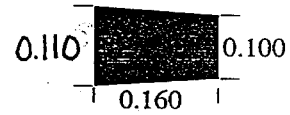
Figure 11:
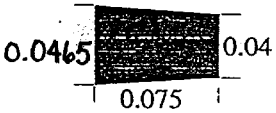
Figure 11:
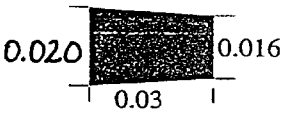

In another embodiment of the present invention, as illustrated in FIG. 11 (without drive holes 20 displayed), satisfactory results were achieved with the dimensions and number of nubs 8 provided in Table 3.

TABLE 3

| | |
|---|---|
| On-Centers (distance between adjacent nubs) | 0.0875 in. |
| Distance between rows of nubs | 0.0758 in. |
| Diameter (at upper end) of large nubs | 0.1100 in. |

TABLE 3-continued

| | |
|---|---|
| Diameter (at upper end) of medium nubs | 0.0465 in. |
| Diameter (at upper end) of small nubs | 0.0200 in. |
| Diameter (at lower end) of large nubs | 0.1000 in. |
| Diameter (at lower end) of medium nubs | 0.0400 in. |
| Diameter (at lower end) of small nubs | 0.0160 in. |
| Length of large nubs | 0.1600 in. |
| Length of medium nubs | 0.0750 in. |
| Length of small nubs | 0.0300 in. |
| Total number of large nubs | 6 |
| Total number of medium nubs | 15 |
| Total number of small nubs | 52 |
| Total number of nubs | 73 |

While this invention has been particularly shown and described with references to preferred embodiments thereof, it will be understood by those skilled in the art that various changes in form and details may be made therein without departing from the spirit and scope of the invention as defined by the appended claims. For example, drive holes having other suitable shapes such as square holes or star-shaped holes can be formed in the present invention spikes for accommodating other common types of driving tools. In addition, although the present invention spikes have been described for providing traction for golf shoes, alternatively, the use of the spikes is not limited to golf shoes but can be employed for other suitable purposes such as soccer, football, and mountain or rock climbing, as well as surfaces other than grass. Furthermore, other geometric designs, number of nubs, and nub sizes may be employed, using a fractal-based design approach to increase surface roughness.

What is claimed is:

1. A removable sport shoe spike for attachment to the sole of a sport shoe wherein the sole has at least one internally threaded socket for receiving the spike, the spike comprising:

(a) a disc having a top portion facing the sole of the shoe and having an opposing bottom portion connected to the top portion, the bottom portion engaging a ground surface when the spike is attached to the shoe;

(b) a cylindrical threaded post extending perpendicularly from the center of the top of the disc, the threaded post being adapted lo be threadedly received by the threaded socket in the shoe sole; and (c) at least 19 spaced apart nubs extending perpendicularly outwardly from the bottom portion of the disc for providing traction between the shoe and the ground surface with nominal impact on the ground surface from gripping the ground surface with the nubs, the nubs having at least three different sizes, wherein the ratio of the length of the largest size nubs to the length of the smallest size nubs is approximately 1.5 or greater, and being dispersed substantially uniformly across the bottom portion of the disc in a close-packed hexagonal lattice arrangement.

2. The spike of claim 1, wherein the nubs are tapered and circular in cross-section, the nubs having an upper end, a lower end, an upper diameter, and a lower diameter, the upper end being connected to the bottom portion of the disc and the lower end engaging the ground surface, and the upper diameter being larger than the lower diameter.

3. The spike of claim 1, wherein the threaded post is constructed of metal and extends down through the disc to the surface of the bottom portion to form a fastener head for engaging the spike so that the spike may be secured to the shoe.

4. The spike of claim 1, wherein the bottom portion of the disc includes a pair of installation engagement holes.

5. The spike of claim 1, wherein the top portion of the disc has a generally concave curve with respect to the shoe sole and the bottom portion has a generally convex curve such that a spring effect is created when the spike is tightened against the shoe.

6. The spike of claim 1, wherein the top portion of the disc is dimpled in texture for fitting in a snug and gripping manner against the shoe sole.

7. The spike of claim 1, wherein the spike is of integral construction and formed from a resilient plastic.

8. The spike of claim 7, wherein the resilient plastic is a polyurethane polyester.

9. The spike of claim 2, wherein the largest nubs are equidistantly arranged from each other around the perimeter of the bottom portion of the disc.

10. The spike of claim 2, wherein the nubs are formed in three different sizes, the different sizes being small, medium, and large.

11. The spike of claim 10, wherein the length of the large nubs is about 0.15 inches to about 0.17 inches.

12. The spike of claim 10, wherein:

(a) the ratio of the number of small nubs to large nubs is about 3:1; and (b) the length of the large nubs is about twice the length of the medium nubs, and the length of the medium nubs is about twice the length of the small nubs.

13. A removable sport shoe spike for attachment to the sole of a sport shoe wherein the sole has at least one internally threaded socket for receiving the spike, the spike comprising:

(a) a disc having a top portion facing the sole of the shoe with an opposing bottom portion to engage a ground surface when the spike is attached to the shoe;

(b) a threaded post extending perpendicularly from the center of the top portion of the disc, the threaded post being adapted to be threadedly received by the socket in the shoe sole;

(c) a countersunk hole formed through the center of the disc and extending up through the center of the threaded post;

(d) a tapered locking screw, the locking screw being sized to cooperate with the countersunk hole of the attachment means such that the post expands laterally as the screw is driven into the countersunk hole to securely fasten the spike to the shoe; and (e) at least 19 spaced apart nubs extending perpendicularly outwardly from the bottom portion of the disc for providing traction between the shoe and the ground surface with nominal impact on the ground surface from gripping the ground surface with the nubs, the nubs having at least three different sizes, the sizes including large, medium and small, wherein the ratio of the length of the large size nubs to the length of the medium size nubs is approximately equal to the ratio of the length of the medium size nubs to the length of the small size nubs, and being dispersed substantially uniformly across the bottom portion of the disc in a close-packed lattice arrangement.

14. The spike of claim 13, wherein:

(a) the nubs are tapered and circular in cross-section, the nubs having a length, and upper end, a lower end, an upper diameter, and a lower diameter, the upper end being connected to the bottom portion of the disc and the lower end engaging the ground surface, and the upper diameter being larger than the lower diameter;

(b) the length of the large size nubs is about 0.15 inches to about 0.17 inches;

(c) the ratio of the number of small size nubs to medium size nubs is about 3:1 and the ratio of the number of medium size nubs to large size nubs is about 2:1; and (d) the bottom portion of the disc has large nubs arranged equidistant from each other around the perimeter of the bottom portion of the disc.

15. The spike of claim 13, wherein the spike is of integral construction and formed from a resilient plastic.

16. The spike of claim 13 wherein:

(a) the bottom portion of the disc includes a pair of installation engagement holes;

(b) the top portion of the disc has a generally concave curve with respect to the shoe sole and the bottom portion has a generally convex curve such that a spring effect is created when the spike is tightened against the shoe; and (c) the top portion of the disc is dimpled in texture for fitting in a snug and gripping manner against the sole.

17. The spike of claim 13, wherein the spike is of integral construction and formed from a resilient plastic.

18. A method of providing secure footing for a sport shoe with a removable spike on turf, wherein the turf contains blades of grass, the method comprising the steps of:

(a) providing a sole on the bottom of the sport shoe and providing at least one internally threaded socket in the shoe sole for receiving the spike;

(b) forming the spike from a resilient plastic, the spike having a top disc portion facing tie sole of the shoe and having an opposing bottom portion engaging the turf when the spike is attached to the shoe;

(c) extending a threaded post perpendicularly outwardly from the center of the top of the disc, the threaded post being adapted to be threadedly received by the threaded socket in the shoe sole;

(d) extending at least 19 spaced apart nubs perpendicularly outwardly from the bottom portion of the disc for providing traction between the shoe and the turf with nominal damage to the turf from gripping the turf with the nubs, the nubs having at least two different sizes, wherein the ratio of the length of the largest size nubs to the length of the smallest size nubs is approximately 1.5 or greater, and being dispersed substantially uniformly across the bottom portion of the disc in a hexagonal close-packed lattice arrangement;

(e) securing the spike to the sole of the shoe;

(f) placing the spike in contact with the turf;

(i) horizontally engaging the turf with the nubs to prevent the shoe from slipping by gripping the blade of grass with the nubs.

* * * * *

UNITED STATES PATENT AND TRADEMARK OFFICE

CERTIFICATE OF CORRECTION

PATENT NO. : 6,338,208 B1
DATED : January 15, 2002
INVENTOR(S) : Mark C. Waterbury It is certified that error appears in the above-identified patent and that said Letters Patent is hereby corrected as shown below:

Title page,
Item [54], title, change "SHORT" to -- SPORT --.

Signed and Sealed this

Twenty-third Day of April, 2002

*Attest:*

*Attesting Officer*

JAMES E. ROGAN
*Director of the United States Patent and Trademark Office*